US005347958A

United States Patent [19]

Gordon, Jr.

[11] Patent Number: 5,347,958

[45] Date of Patent: Sep. 20, 1994

[54] HEAT RECOVERY APPARATUS AND AN IMPROVED HEAT RECOVERY METHOD

[76] Inventor: Merrill K. Gordon, Jr., P.O. Box 841, Winfield, Kans. 67156

[21] Appl. No.: 998,954

[22] Filed: Dec. 31, 1992

[51] Int. Cl.[5] ..... F22B 33/00

[52] U.S. Cl. ..... 122/20 B; 110/162; 110/204; 110/206; 431/115

[58] Field of Search ..... 110/162, 204, 206, 233; 122/20 A, 20 B; 431/115

[56] References Cited

U.S. PATENT DOCUMENTS 4,185,685 1/1980 Giberson ..... 110/162 X 4,403,599 9/1983 Copenhaver ..... 110/162 X

*Primary Examiner*—Edward G. Favors

*Attorney, Agent, or Firm*—John Wade Carpenter

[57] ABSTRACT

An apparatus for recovering heat, and a flue gas recovery and/or recirculation and/or induced draft apparatus for boilers. The apparatus for recovering heat may be used in combination with the flue gas recovery and/or recirculation and/or induced draft apparatus for boilers. The flue gas recovery and/or recirculation and/or induced draft apparatus receives combustion gases from the apparatus for recovering heat and recirculates a portion of the combustion gases to a burner of a boiler and transmits the remaining portion of the combustion gases through a flue that communicates with the atmosphere.

33 Claims, 5 Drawing Sheets

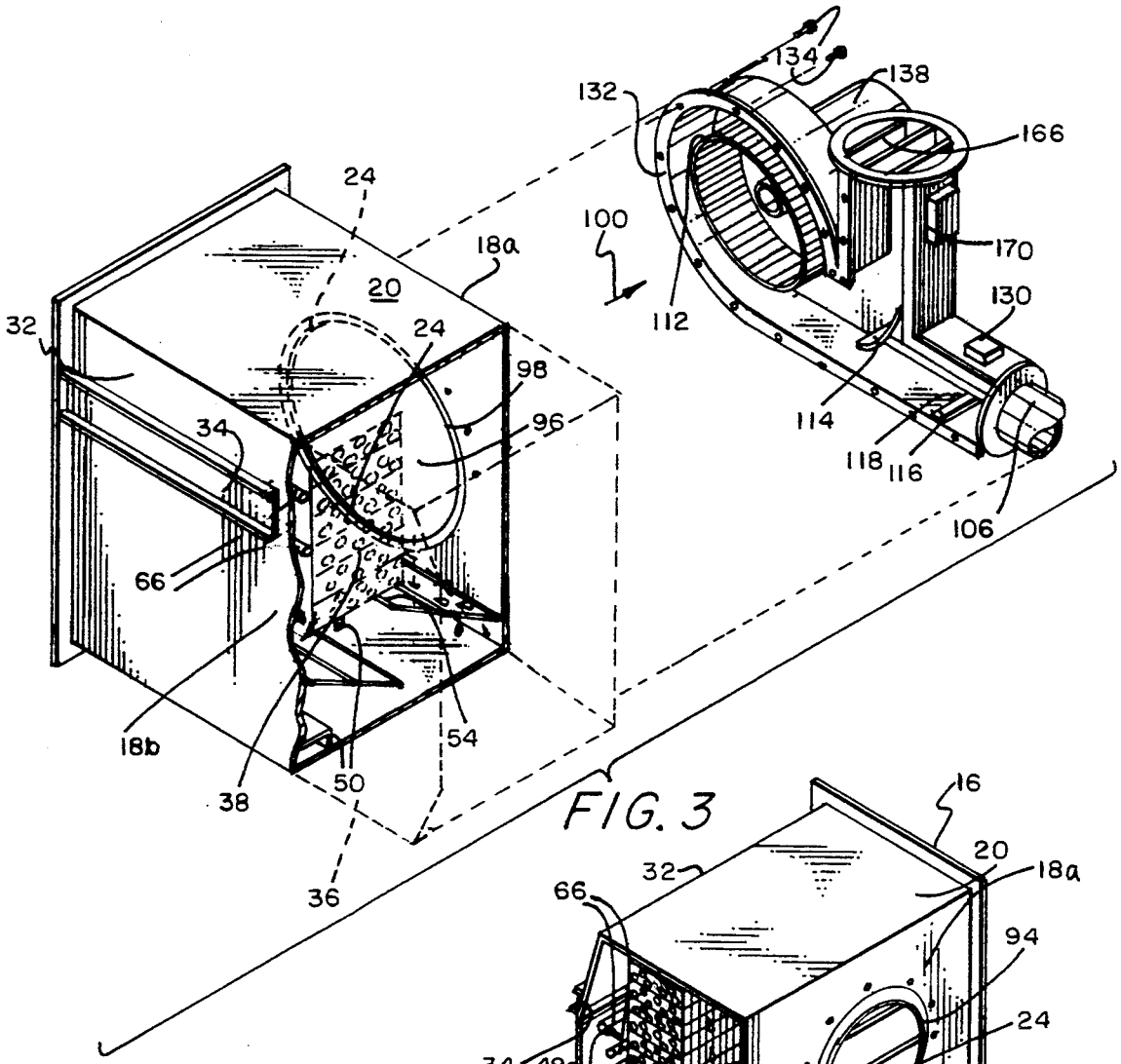
FIG. 3
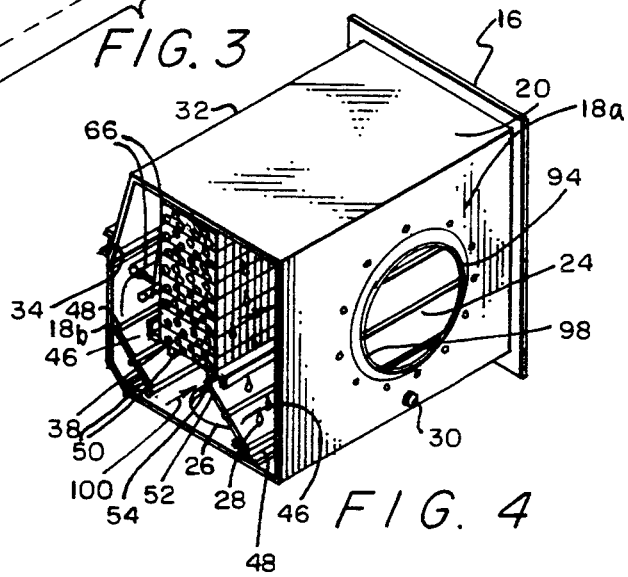
FIG. 4
FIG. 5
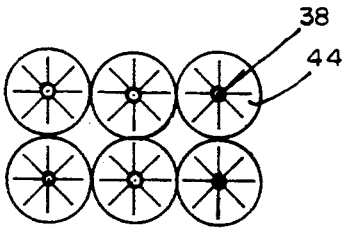
FIG. 6
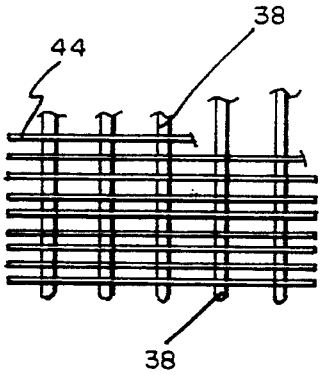

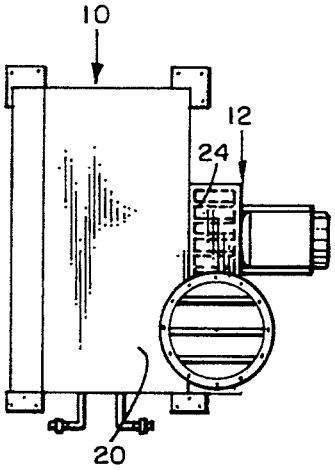
FIG. 10
FIG. 11
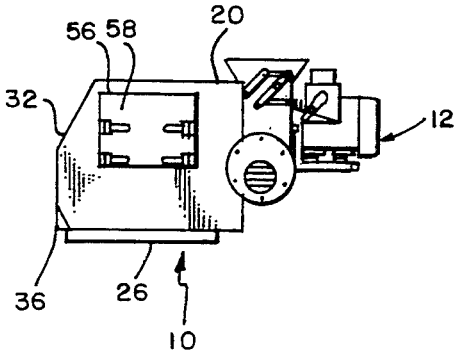
FIG. 12
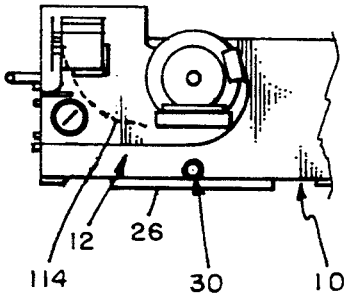
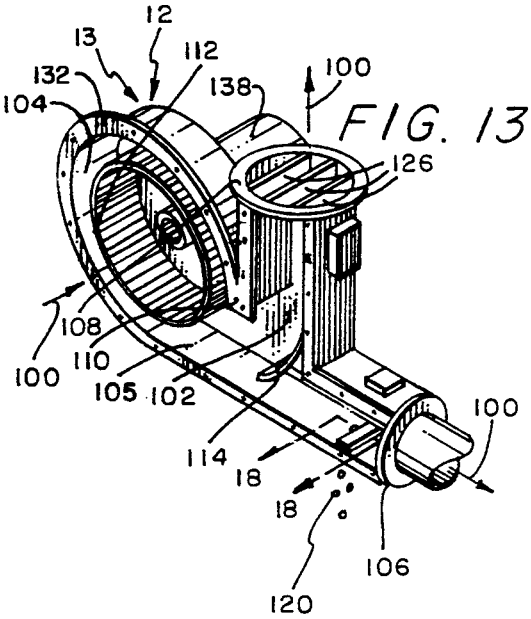
FIG. 13
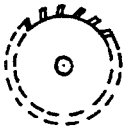
FIG. 14a
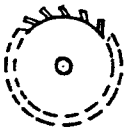
FIG. 14b
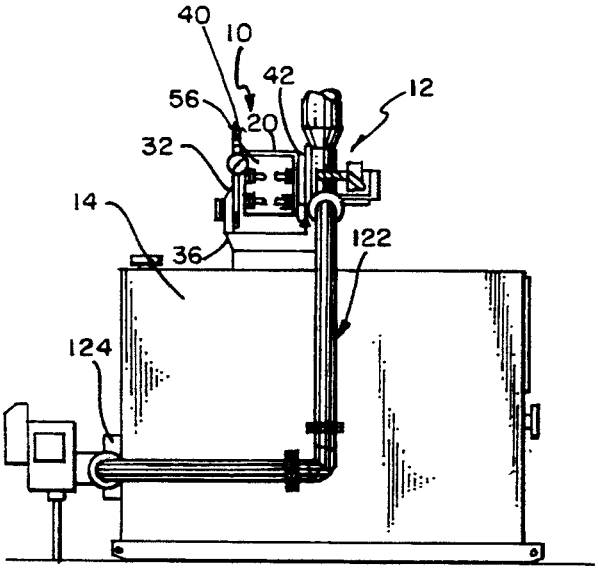
FIG. 15

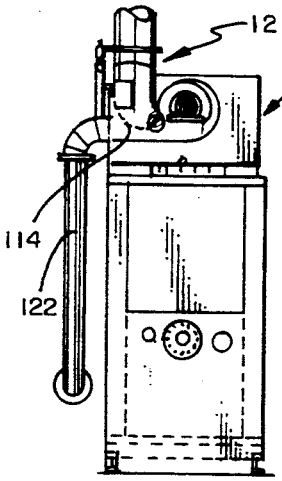
FIG. 16
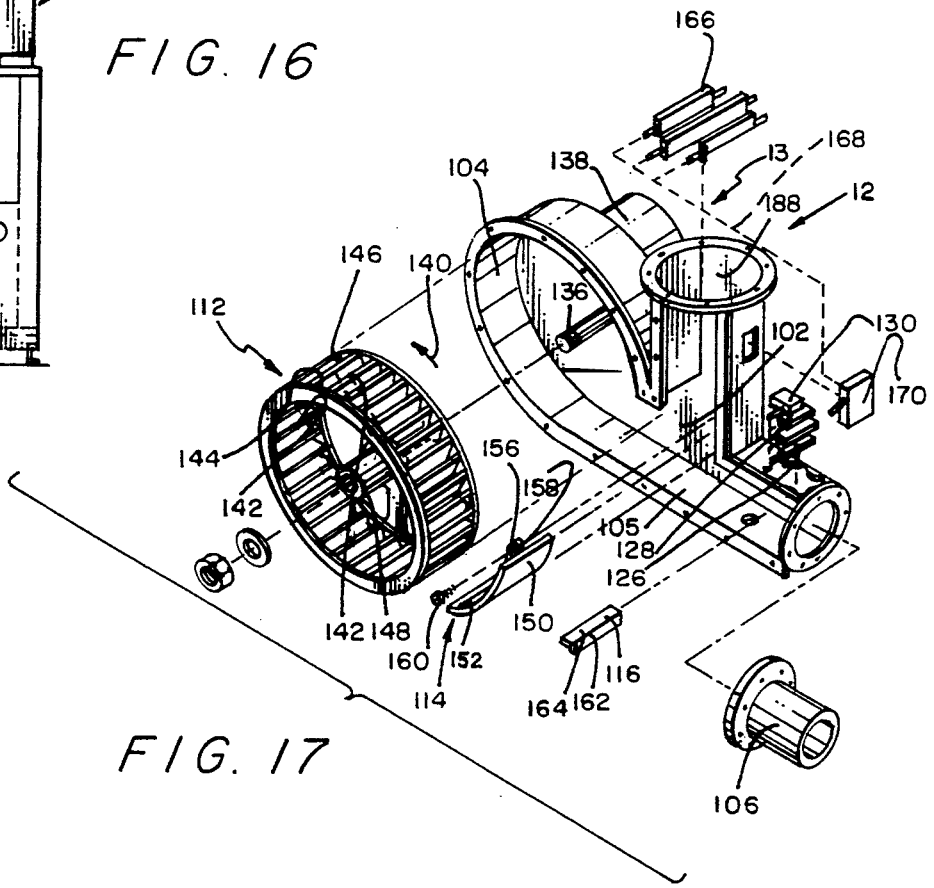
FIG. 17
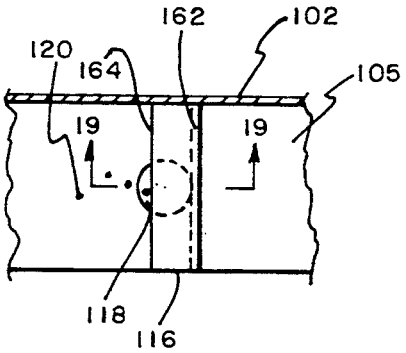
FIG. 18
FIG. 19
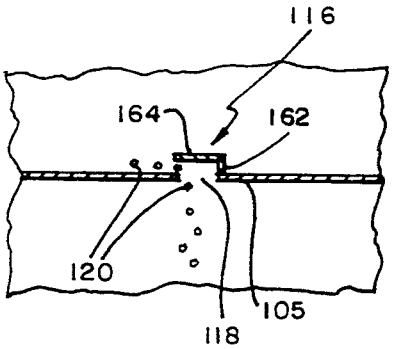

HEAT RECOVERY APPARATUS AND AN IMPROVED HEAT RECOVERY METHOD

FIELD OF THE INVENTION

The present invention is related to an improved heat recovery apparatus and an improved method for recovering heat; all, optionally, in combination with an improved flue gas recovery and/or induced draft apparatus and method. More specifically, the present invention contemplates an apparatus and method for recovering heat by initially diverting the flow of hot combustion gases towards and/or through a heat exchanger and subsequently receiving the combustion gases from the heat exchanger and recirculating a portion of the combustion gases to a burner (e.g. a burner of a boiler) and transmitting the remaining portion of the combustion gases through a flue that communicates with the atmosphere.

DESCRIPTION OF THE PRIOR ART

A patentability investigation was conducted and the following U.S. Pat. Nos. were discovered: 1,015,746 to Speer; 1,091,013 to Packard; 1,310,173 to Callery; 1,466,073 to Tomes; 4,098,200 to Dauvergne; 4,659,305 to Nelson et al.; 4,699,071 to Vier et al.; and 4,926,765 to Dreizler et al.

Thus, the use of industrial boilers to produce steam for heating and other uses is well-known as are the fuels used in the combustion process for heating the water. The control of emissions from such operations has now become a priority. This invention is an improvement over my U.S. Pat. No. 4,583,495 (fully incorporated herein as if repeated verbatim hereafter), and provides a method and apparatus for increasing the efficiency of combustion of fossil fuels in boiler burners.

SUMMARY OF THE INVENTION

This invention accomplishes its desired objects by providing an improved heat recovery apparatus and/or an improved flue gas recovery and/or induced draft apparatus for boilers, or the like, comprising a heat recovery housing and a flue gas recovery and/or induced draft housing secured thereto and communicating therewith. The heat recovery housing comprises a pair of side walls, a top and a bottom connected to the side members, a heat exchanger disposed therein, an aperture disposed in one of the side members, and an inlet cone secured thereto and around the aperture. The flue gas recovery and/or induced draft housing comprises a fan shrouding to convey combustion gas, a fan disposed within the fan shrouding to circulate combustion gas, a side wall, and a diverter secured to the flue gas recovery and/or induced draft housing to adjustably divert a portion of the flue gas to a recirculation duct. A recirculation duct is secured to the fan shrouding to convey a portion of combustion gas back to a burner, and a condensate drain is secured to and/or formed in a bottom of the flue gas recovery housing. A condensate stop member is situated above the condensate drain to stop condensate from entering the recirculation duct, and a flue gas outlet duct is interposed between the fan shrouding and the recirculation duct.

This invention further accomplishes its desired objects by providing an improved apparatus and method of recovering heat from hot combustion gases flowing through a combustion inlet in a bottom of a heat recovery housing. The heat recovery housing includes a pair of side walls including a flue gas exit in one of the side walls, a pair of end walls, a top, and a plurality of interconnected water conduit tubes. The water conduit tubes are connected to a circuitous water supply that provides cold water to the interconnected water conduit tubes and carries away warmed water from them. The interconnected water tubes pass circuitously though the heat recovery housing. Additionally the flue gas recovery and/or induced draft apparatus recirculates a portion of the combustion gas that come from the heat recovery housing back to a burner. The flue gas recovery and/or induced draft housing comprises a bottom, an arcuate end member, a generally upright cylindrical gas flue, a generally horizontal cylindrical recirculated gas flue, a fan, and a diverter member. The process includes the steps of: providing a heat recovery housing; installing a first condensate drain in one of the side walls of the heat recovery housing; securing an inlet cone member around the flue gas exit of the heat recovery housing; providing a flue gas recovery and/or induced draft housing; disposing a second condensate drain the bottom of the flue gas recovery and/or induced draft housing; securing a generally L-shaped condensate trap member above the condensate drain; securing a lip member to the diverter; adjusting the diverter; rotating the fan for drawing the combustion gases through the flue gas recovery and/or induced draft housing; passing a portion of the combustion gas above the diverter and out the generally upright gas flue; passing a portion of the combustion gas under the diverter, over the condensate trap and condensate drain, and through the generally horizontal recirculated gas flue; and passing the recirculated gas back to a burner.

It is therefore an object of the present invention to provide an apparatus and method for recovering heat and producing combustion gases, where a portion of the combustion gases are transmitted to a burner and the remaining portion of the combustion gases are transmitted through a flue for venting into the atmosphere.

Further objects of the invention reside in the provision of an improved heat recovery apparatus and process. These together with the various ancillary objects and features will become apparent as the following description proceeds, are attained by this invention, preferred embodiments being shown in the accompanying drawings by way of example only, wherein:

BRIEF DESCRIPTION OF THE DRAWINGS

FIG. 3 is a segmented perspective view of the heat recovery apparatus and the flue gas recovery and/or recirculation and/or induced draft apparatus with the flue gas recovery and/or recirculation and/or induced draft apparatus disassembled in direction of the arrows therefrom;

FIG. 4 is a perspective view of the heat recovery apparatus;

FIG. 5 is a cross sectional view of a portion of one embodiment of the water conduit tubes of the heat recovery apparatus;

FIG. 6 is a partial top plan view of one embodiment of the water conduit tubes of the heat recovery apparatus;

FIG. 10 is a top plan view of the heat recovery apparatus and the flue gas recovery and/or recirculation and/or induced draft apparatus;

FIG. 11 is a side elevational view of the heat recovery apparatus and the flue gas recovery and/or recirculation and/or induced draft apparatus;

FIG. 12 is a rear elevational view of the heat recovery apparatus and the flue gas recovery and/or recirculation and/or induced draft apparatus;

FIG. 13 is a perspective view of the flue gas recovery and/or recirculation and/or induced draft apparatus;

FIG. 14A is a front elevational view of one embodiment of the fan having a plurality of blades protruding in a forward inclination to circulate combustion gases;

FIG. 14B is a front elevational view of one embodiment of the fan having a plurality of blades protruding in backward inclination to circulate combustion gases;

FIG. 15 is a side elevational view of the heat recovery apparatus and the flue gas recovery and/or recirculation and/or induced draft apparatus mounted to a boiler with a flue gas recovery and/or recirculation duct extending from the flue gas recovery and/or recirculation and/or induced draft apparatus to the boiler burner;

FIG. 16 is a rear elevational view of the heat recovery apparatus and the flue gas recovery and/or recirculation and/or induced draft apparatus mounted to a boiler with a flue gas recovery and/or recirculation duct extending from the flue gas recovery and/or recirculation and/or induced draft apparatus to the boiler burner;

FIG. 17 is a segmented perspective view of the flue gas recovery and/or recirculation and/or induced draft apparatus with the various elements removed therefrom.

FIG. 18 is a partial top plan view of the condensate drain and condensate trap; and FIG. 19 is a vertical sectional view taken in direction of the arrows and along the plane of line 19—19 in FIG. 18.

DETAILED DESCRIPTION OF THE INVENTION

Figure 1:
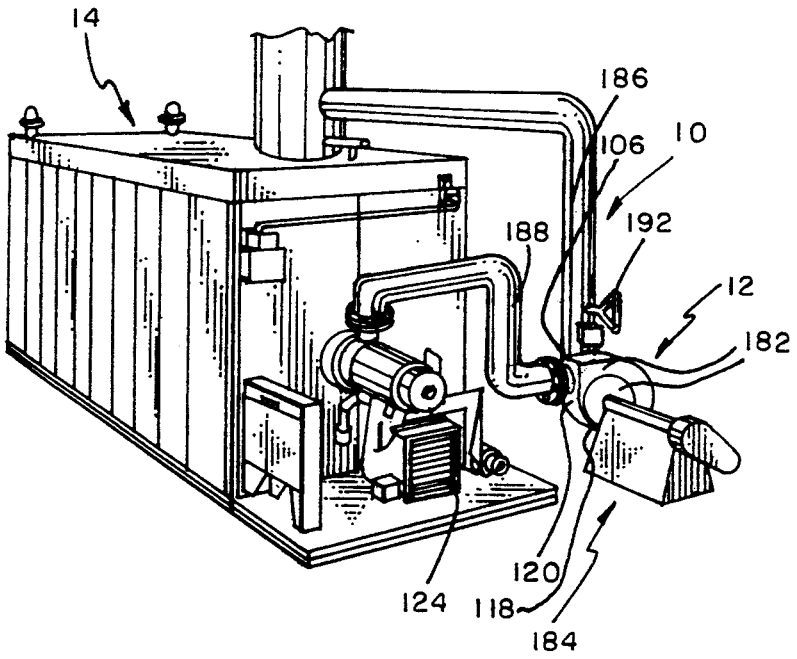
FIG. 1 is a perspective view of a boiler having a flue gas recirculation apparatus mounted thereon for recirculating a portion of the flue gas to the burner of the boiler and the transmitting the remaining portion through a flue for venting into the atmosphere.
Figure 2:
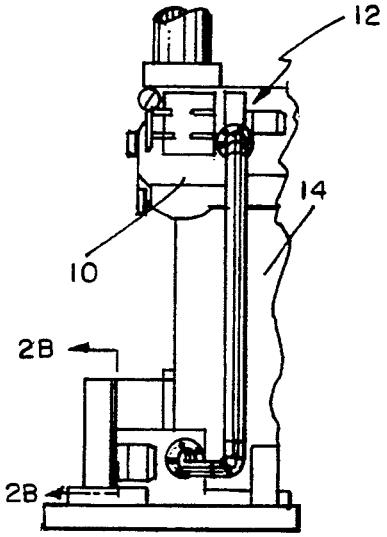
FIG. 2 is a partial side elevational view of an embodiment of the heat recovery and flue gas recovery and/or recirculation and/or induced draft apparatus with a flue gas recovery and/or recirculation duct extending from the flue gas recovery and/or recirculation and/or induced draft apparatus to the boiler burner and attaching to the boiler burner at an angle.
Figure 2B:
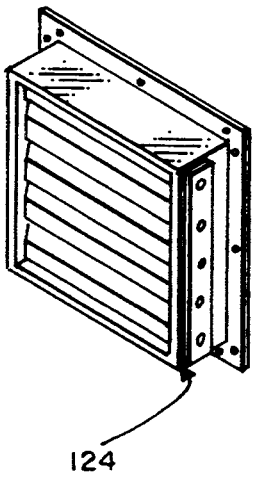
FIG. 2B is a perspective sectional view of the burner air inlet taken in direction of the arrows and along the plane of line 2B—2B in FIG. 2.
Figure 7:
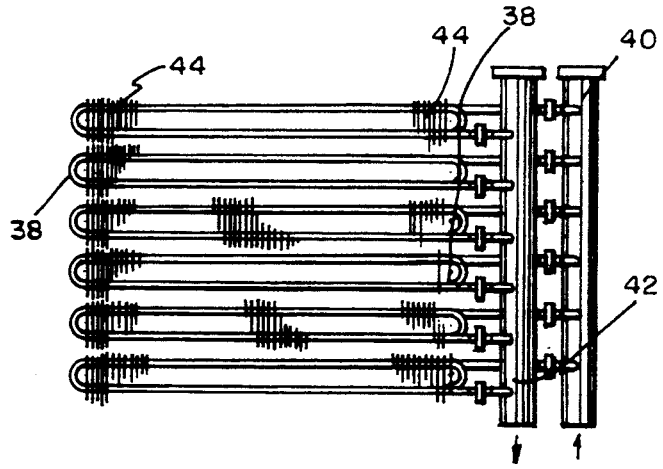
FIG. 7 is a side elevational view of the water tubes of the heat recovery apparatus.

Referring in detail now to the drawings wherein similar parts of the invention are identified by like reference numerals, there is seen a heat recovery apparatus 10, which is fully described in U.S. Pat. No. 4,583,494 and which is fully incorporated herein with reference thereto as if repeated verbatim hereafter. There is additionally seen a flue gas recovery and/or recirculation and/or induced draft apparatus, generally referred to as 12, mounted to the heat recovery apparatus 10. The heat recovery apparatus 10 and flue gas recovery apparatus 12 are mounted to a boiler 14 or the like. The heat recovery apparatus 10 has a pair of side walls **18*a*–18*b*; a pair of end walls 16—16 connected to the side walls 18*a*–18*b*; a top 20 and a bottom 22, both of which are connected to the side walls 18*a*–18*b* and the end walls 16—16. Side wall 18*a* includes an inlet cone 24 (see FIG. 4) for the routing of combustion gases to the flue gas recovery apparatus 12. Bottom 22 has a combustion gas inlet 26 which is in communication with the products of combustion from the boiler 12. A condensate drain 30 is positioned in the bottom of side wall 18*a* to allow condensate 28 from the cooled combustion products to escape. Side wall 18*b* additionally has an upper angularly shaped wall section 32 with a door 34 for inspection of the inner cavity of the heat recovery apparatus 10, and a lower angularly shaped wall section 36**.

Passing circuitously throughout the inner cavity of the heat recovery apparatus 10 are a plurality of interconnected water conduit tubes 38 which are interconnected to a cold water inlet 40 and interconnected to a hot water outlet 42. The cold water inlet 40 and hot water outlet 42 each are in communication with one of the end walls 16. A plurality of cooling fins 44 is mounted on and around the water conduit tubes 38 in order to facilitate more efficient heat transfer when combustion gases form the boiler 12 pass over and around the conduit tubes The cooling fins 44 structurally may be one of several embodiments. FIG. 5 shows a spiral arrangement of the cooling fins 44. FIG. 6 discloses a plate type arrangement. Top 20 is supported by the water conduit tubes 38, and the water conduit tubes 38 are supported by a support member 54. The cold water inlet 40 and hot water inlet 42 both pass through an aperture 58 in side wall 16, which is covered by a cover plate 56.

A plurality of by-pass dampers 46 is pivotally disposed between side walls 16—16. The by-pass dampers 46 each comprise a by-pass damper flange member 48 at each edge such that when closed, the closed by-pass dampers engage a plurality of closed position ledge members 52. Additionally, as shown in FIG. 4, the by-pass damper flange member 48 may engage another plurality of open position ledge members 52, when the dampers 46 are in the open position. In the open position, the dampers 46 have a generally perpendicular posture in relation to the angled side wall 32. In this position (open) the dampers 46 effect a generally 90° turn of the combustion gases from boiler 14 such that they pass over the cooling fins 44 of the water conduit tubes 38 heating water 39 passing therethrough before passing through the inlet cone 24 into the flue gas recovery and/or recirculation and/or induced draft apparatus 12. In the closed position, the dampers 46 have a generally parallel posture to the angled side wall 32. In the closed position the dampers 46 route the combustion gases directly to the inlet cone 24 and into the flue gas recovery and/or recirculation and/or induced draft apparatus 12.

Figure 8:
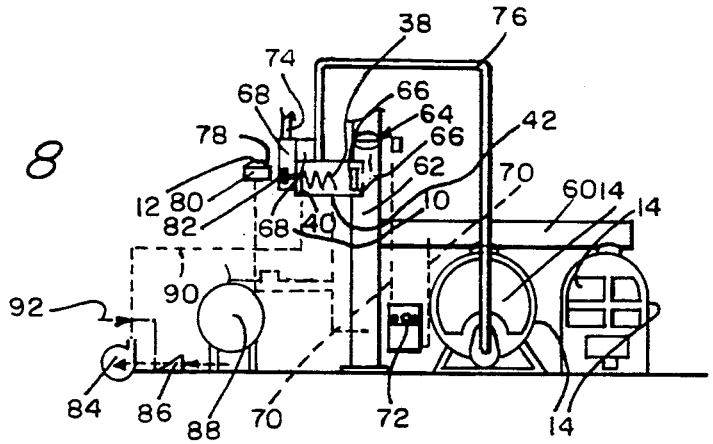
FIG. 8 is schematic diagram of one embodiment of the invention on how the process for recovering heat and recirculating flue gas operates.

FIG. 8 is a schematic flow-diagram of another embodiment of the invention, with the exhaust gases of boilers 14—14 in communication with an exhaust conduit 60 that merges with a stack 62. A motorized stack damper, generally illustrated as 64, is attached to the stack 62 for pivotally controlling the gases when no heat recovery apparatus 10 is used. However, in a preferred embodiment of the invention, heat recovery apparatus 10 is used and additionally includes an auto soot blower 66, the flue gas and/or induced draft apparatus 12, and an automatic draft control means 68 for regulation of the combustion gas flow. The automatic draft control means 68 is electrically draft sensorially attached via line 70 to a control panel means 72 that is also electrically draft sensorially attached (or in communication with) to the inside of exhaust conduit 60 via another line 70. Additionally there is another draft control means 68 for the further regulation of the exhaust combustion gas electrically draft sensorially attached to the flue gas recover and/or induced draft apparatus 12 in the exhaust stack 74. Further, yet another automatic draft control means 68 is electrically draft sensorially attached to the flue gas recirculation conduit 76. The recirculated combustion gases are driven by a fan means 78 for recirculating such gases. The fan means 78 comprises a fan motor 80 and a fan blade member 82 and the fan motor 80 is electrically connected via line 70 to the control panel means 72 such that it may be engaged or disengaged where flue gas recovery and/or recirculation and/or induced draft is desired. Based on what the draft sensor line 70 in communication with the exhaust conduit 60 signals to the control panel 72, the automatic draft control means 68 adjusts the draft through the stack 74 that is attached to the flue gas recovery and/or recirculation and/or induced draft apparatus 12. A pump 84 pumps 60° to 140° water from a hot water storage tank 88 and/or city water 92 (having passed through a water softener) through valve 86 into the water conduit 90. The water enters the heat recovery apparatus at the cold water inlet 40, where it is pumped through the circuitous water conduit pipes 38 therein, and leaves then leaves the heat recovery apparatus through hot water outlet 42. The water is pumped back into the hot water storage tank 88 via water conduit 90.

In one embodiment, the flue gas recovery and/or recirculation apparatus and/or induced draft apparatus 12 is attached to side 18*a* of the heat recovery apparatus 10 (see FIG. 3) by welding or a plurality of bolt members or the like. The heat recovery apparatus 10 (see FIG. 4) has an aperture 96 whereon an inlet cone 24 is attached to aid in the smooth conduction of combustion gases through said aperture 96. Inlet cone 24 comprises a structure defining a flat circular ring-shaped flange 94 having an semi-arcuate lip member 98 extending from the inside edge of the flange 94 such that the lip circumferentially is attached to the flange 94 and protrudes from the heat recovery apparatus 10. In one embodiment the flange 94 of inlet cone 24 is attached to side 18*a* of the heat recovery apparatus 10 on the outer side of side 18*a*. In another embodiment, flange 94 is attached to the inner edge of side 18*a*

In reference now to FIG. 13, the flue gas recovery and/or recirculation and/or induced draft apparatus 12 of the invention is seen in a perspective view removed from the heat recovery apparatus 10, to which it may be attached in one embodiment, with the arrows 100 indicating the direction of the flow of combustion gases. In the embodiment depicted in FIG. 13, the flue gas recovery and/or recirculation and/or induced draft apparatus 12 comprises a flue gas recovery housing 13, which comprises a side wall 102, a generally arcuate fan shrouding 14 attached to the side wall 12, a generally cylindrical, upright flue gas duct 108 connected to the side wall 12 and to the fan shrouding 104 via partition member 110, a generally horizontal bottom 105, a generally horizontal cylindrical flue gas recirculation duct 106 connected to the side wall 14 and to the bottom 105, and a fan 112, disposed in fan shrouding 104. The fan 112 directs combustion gases to a diverter, generally illustrated as 114, which directs a first portion of the combustion gas to the flue gas duct 108 and a second portion to the flue gas recirculation duct 106. As the gas flows towards the flue gas recirculation duct 106, it is forced, by fan 112, over a condensate trap 116 which is secured thereby and to said bottom 105. Condensate trap 116 is positioned to the bottom 105 above a condensate drain 118, which allows a condensate 120 to leave the flue gas recovery and/or recirculation and/or induced draft apparatus 12 thereby. The second portion of the combustion gas is then routed via flue gas recirculation duct 106 to a recirculated flue gas conduit 122 back to a burner inlet 124 (see FIG. 15) where it is mixed with fresh air in the combustion process to cool the temperature of the combustion and thereby reduce the amount of $NO_x$ emissions in the combustion products. The flue gas recirculation duct (see FIG. 13) additionally comprises at least one flue gas recirculation damper member 126 disposed therein, and specifically in one embodiment a plurality of damper members 126—126 is attached to a flue gas recirculation damper shaft 128. The flue gas recirculation damper shaft 128 is coupled to a flue gas recirculation damper actuator 130 which is secured to the flue gas recovery housing 13. The flue gas recirculation damper members 126—126 serve to further regulate the amount of combustion gas routed back to the burner inlet 124. In this embodiment, the housing 13 generally is secured to side 18*a* (see FIG. 3) of the heat recovery apparatus 10 by a plurality of bolt members 134 (or welded attachment) passing through a securing flange member 132. The securing flange member 132 passes perimetrically around the housing 13 of the flue gas recovery and/or recirculation and/or induced draft apparatus 12, and serves to secure the housing 13 to side 18*a* of the heat recovery apparatus 10.

Turning now to FIG. 17 there is seen a fan 112 removed from the fan shrouding 104. The fan 112 comprises a structure defining a plurality of angularly positioned blade members 142 disposed between a ring member 144 and an opposing circular plate member 146. The opposing circular plate member 146 of the fan 112 has a coupling member 148 secured thereto where it attaches to a motor shaft 136, which is coupled to a motor 138. Motor 138 is secured to side 102 of the flue gas recovery and/or recirculation and/or induced draft housing 13. As shown in FIG. 10, the inlet cone 24 that is attached to side 18*a* of the heat recovery apparatus 10 is positioned within the inner circumference of fan 112 to smoothly and precisely direct combustion gas flow thereto. Fan 112 turns in a counter-clockwise direction (clockwise is OK also if housing is reversed accordingly), as shown by arrow 140 in FIG. 17, and directs the combustion gas around fan shrouding 104 to diverter 114. Diverter 114 comprises a first plate member 150, a second plate member 152, and a hinge member 154, which couples first plate member 152 to second plate member 152. First plate member 150 may be semi-arcuate to flat in shape and is secured inside the flue gas duct 108 such that it opposes the fan 112. The second plate member 152 is hingeably secured to the first plate member 150 via hinge member 154. The angular posture of the second plate member 152 is adjustable relative to the first plate member for adjusting the amount of diversion of combustion gas to the flue gas recirculation duct 106. Once it has been adjusted, the second plate member 152 is secured into position. To secure the second plate member into adjusted position, a lip member 156 is secured to the second plate member 152 such that it may be fastened to the side wall 102 of the flue gas recovery and/or recirculation and/or induced draft housing 13. Lip member 156 has an aperture 158 disposed therein to receive bolt member 160.

After a portion of the combustion gas (i.e. from 10% vol. to about 40% by vol., preferably 15 to 25% by vol., more preferably about 20% by vol.) has been diverted towards the flue gas recirculation duct 106, it passes the condensate trap 116. Condensate trap 116 (refer to FIG. 18) comprises a structure defining a partition member 162 secured to the bottom 105 and a trap plate member 164 secured to the side wall 102 and the partition member 162 which is generally L-shaped in cross section. Condensate trap 116 is secured to the bottom 105 of the flue gas recovery and/or recirculation and/or induced draft housing 13 and positioned above condensate drain 118. Condensate 120 that is formed within the flue gas recovery and/or recirculation and/or induced draft housing 13 is forced by fan 112 to the outside edge of the circumference of the gas flow. As such, it is effectively stopped by partition member 162 and falls though the condensate drain 118.

The amount of combustion gas leaving the flue gas duct 108 is regulated by at least one flue gas damper member 166 disposed therein, and specifically in one embodiment a plurality of damper members 166—166 is attached to a flue gas damper shaft 168. The flue gas damper shaft 168 is coupled by a damper arm and rod to a flue gas recirculation damper actuator 170 which is secured to the flue gas recovery housing 13. The flue gas recirculation damper members 166—166 serve to further regulate the amount of combustion gas routed to the atmosphere.

In another embodiment, the flue gas recovery and/or recirculation apparatus 12, as shown in FIG. 1, may be used independently from the heat recovery and/or recirculation apparatus 10, as a stand-alone flue gas recovery apparatus 12 where no heat recovery or induced draft is desired. In this embodiment the flue gas recovery an/or recirculation apparatus 12 comprises a pair of sides 182—182, a fan assembly 184, a flue gas feeder conduit 188, a flue gas feeder damper assembly 192, a flue gas recirculation duct 106, a condensate drain 118 and condensate trap 116 disposed therein, and a flue gas recirculation conduit 190 which routes flue gas back to the burner air inlet 124, where it is re-used in the combustion process.

Figure 9:
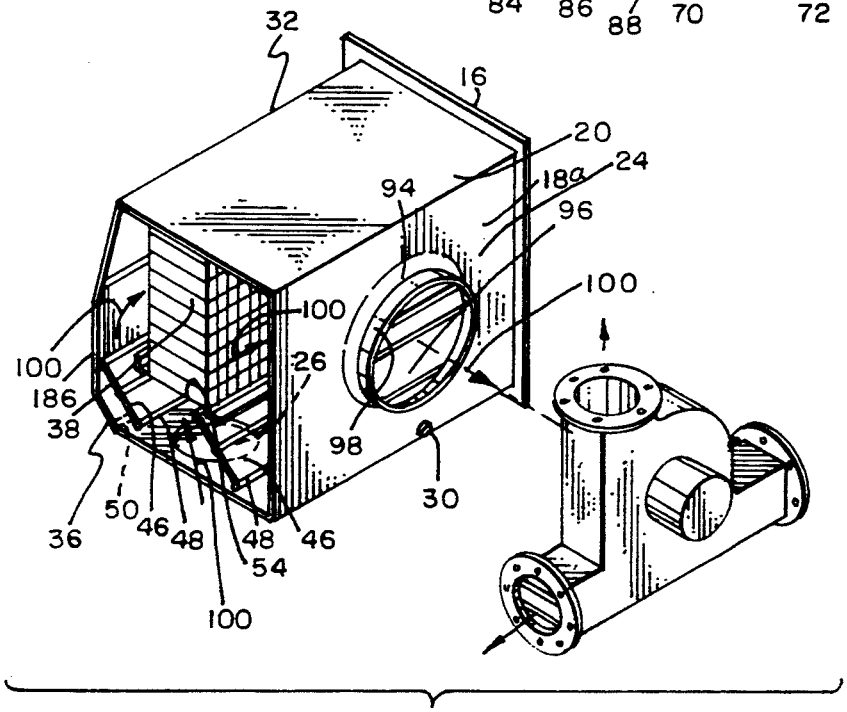
FIG. 9 is a segmented perspective view of the heat recovery apparatus and the flue gas recovery and/or recirculation and/or induced draft apparatus with the flue gas recovery and/or recirculation and/or induced draft apparatus separated therefrom with the arrows indicating the flow of combustion gases from the heat recovery apparatus into the flue gas recovery and/or recirculation and/or induced draft apparatus and through the flue gas recovery and/or recirculation and/or induced draft apparatus with one vertical arrow representing a portion of the gas to be passed from the housing through the flue and the other horizontal arrow representing the remaining portion of the gas to be passed from the housing and back to the boiler burner.

With continuing reference to the drawings for operation of the invention and the preferred process for recovering heat and/or recovering flue gas and/or inducing a draft, condensate drain 30 is installed in the bottom 22 of the heat recovery housing. At least two by-pass dampers 46—46 are pivotally connected between end walls 16—16 of the heat recovery housing. An aperture is disposed in side wall **18*a* of the heat recovery housing and an inlet cone 24 is attached circumferentially thereto. By-pass dampers 46—46 may be operated manually or, in a preferred embodiment, from a control means (such as control panel 72) which is in accordance with the amount of combustion gas as measured thereby. In an open position, by-pass dampers 46—46 route the combustion gas such that it does not pass over the interconnected water conduit tubes 38. In this position the gases are routed directly to the aperture 96 disposed in side wall 18*a* and through inlet cone 24 to the flue gas recovery and/or recirculation and/or induced draft apparatus 12. Shown in a closed position in FIG. 9, by-pass dampers 46—46 route the combustion gases so that the gases pass over the interconnected water conduit tubes 38 and heat water passing therethrough, thus recovering heat from the combustion gases. In the case where the by-pass dampers 46—46 are closed, the vector of the gases is changed such that they are routed over the interconnected water conduit tubes 38, where a heat exchange occurs, before they are conducted in a straight line to the aperture 96 disposed in side wall 18*a* of the heat recovery housing to which the flue gas recovery and/or recirculation and/or induced draft apparatus 12 is secured. The change in direction of the combustion gas flow is about 90° as said gases pass by-pass dampers 46—46 and angled wall section 36 of the heat recovery housing. The gases as they pass through the interconnected water conduit tubes 38 do not change direction as they pass through inlet cone 24 and into the flue gas recovery and/or recirculation and/or induced draft apparatus 12**.

Once the combustion gases have passed from the heat recovery apparatus 10, the structure of inlet cone 24 attached thereto directs the gases smoothly to the fan 112 rotatably secured with the flue gas recovery and/or recirculation and/or induced draft housing 13. The inlet cone 24 channels the combustion gases via semi-arcuate edge 98 to minimize turbulence as the gases are conducted by fan 112. The fan 112 then effects a 90° turn on the gases and forces them around the fan shroud 104 and to the diverter 114. Diverter 114 divides the combustion gas flow: from 15% to 30% of the gas continues ahead to the recirculated flue gas duct 126, the remaining 70% to 85% is directed upwards by the diverter 114 to the flue gas duct 108. The flue gas duct 108 has disposed therein at least one damper member 166, and in a preferred embodiment at least two damper members 166—166, to regulate the combustion gas flow as such gas exits the flue gas recovery and/or recirculation and/or induced draft housing 13. The dampers 166—166 are pivotally disposed in the flue gas duct 108 and the flue gas damper shaft 168 is attached to the dampers 166—166 to pivotally open or close them. The flue gas damper shaft 168 is attached to a flue gas damper actuator 170 which is regulated in one embodiment by the control panel means 72 to coordinate the amount of combustion gas exiting therefrom. The flue gas damper actuator 170 opens or closes the dampers 166—166 electrically. In a similar fashion, the recirculation flue gas duct 106 has positioned therein the flue gas recirculation damper 126 (or in a preferred embodiment at least two of said dampers 126—126) which is attached to the flue gas recirculation damper shaft 128. The flue gas recirculation damper shaft 128 is coupled to the flue gas recirculation damper actuator 130. The combination of the flue gas recirculation damper 126, shaft 128, and actuator 130 are regulated manually or electronically (such as by control panel 72) to further regulate the amount of combustion gas sent back to the burner inlet 124 that comes past diverter 114. Before the combustion gas reaches the flue gas recirculation damper 126 however, it passes by condensate trap 116 and condensate drain 118. Since the condensate 120 formed in the combustion gas flow is heavier than the combustion gas, it is forced to the outside of the flow by fan 112 and travels along the fan shroud 104 and bottom 105. Condensate trap 116 stops the forward movement of the condensate 120 by blocking such movement with partition 162. The condensate is then forced through the condensate drain by gravity and/or by the force of fan 112. The combustion gas then enters the flue gas recirculation duct 106 where it is routed back to the burner inlet 124 for recombustion.

Thus by the practice and use of this invention, a burner and boiler in combination, yield increased efficiency with lower pollution, due to the decrease in temperature of the recirculated gas produces to the burner. Additionally, the use of the heat recovery apparatus provides heated water that may be used to preheat the water of the boiler so that less fuel overall is used in the heating process. Further, by the burner's reduced use of combustion fuel, overall emissions from combustion are automatically lowered. Further yet, the heat recovery apparatus lowers exhaust combustion gas pressure at the combustion gas outlet by its cooling process, thus reducing the size of the motor required by the flue. A recirculated flue gas that is lowered in temperature will lower also $NO_x$ emissions. Finally, energy consumption by the recirculation fan is lowered, as well as radiated heat in the burner area since less overall heat radiation by recirculation gas ducting occurs, due to the reduced size and temperature of such ducting.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A flue gas recovery and/or recirculation and/or induced draft apparatus comprising a generally hollow housing; a fan rotatably secured to and within said housing; a motor secured to said housing for rotatably driving the fan; at least one flue gas damper pivotally mounted within the housing; a flue gas damper actuator connected to the housing for controlling and moving the flue gas damper; a diverter member adjustably secured to and within the housing for controlling and adjusting the quantity of flue gas to be emitted into a flue and to be recirculated to a burner; at least one recirculated gas damper pivotally mounted within the housing; and a recirculated gas damper actuator connected to the housing for controlling and moving the recirculated gas damper.

2. The flue gas recovery and/or recirculation and/or induced draft apparatus of claim 1 wherein said housing has a structure defining a generally cylindrical fan shroud wherein said fan is rotatably secured, a flue gas conduit for channeling and conducting combustion gas from the generally cylindrical member towards a flue, and a flue gas recirculation duct to convey a portion of combustion gas towards a burner.

3. The flue gas recovery and/or recirculation and/or induced draft apparatus of claim 1 wherein said fan comprises a structure defining a pair of opposed rings and a plurality of angularly disposed fan blades secured at each end between the opposed rings, and wherein one of said opposed rings comprises a securing means for securing the fan blade to the shaft of a motor.

4. The flue gas recovery and/or recirculation and/or induced draft apparatus of claim 3 wherein said plurality of fan blades comprise a structure defining a forwardly inclined angular position with respect to the rotation of the fan blade.

5. The flue gas recovery and/or recirculation and/or induced draft apparatus of claim 3 wherein said plurality of fan blades comprise a structure defining a backwardly inclined angular position with respect to the rotation of the fan blade.

6. The flue gas recovery and/or recirculation and/or induced draft apparatus of claim 4 wherein said diverter member comprises a first semi-arcuate plate member secured to said housing; a second plate member pivotally secured to the first plate member; a hinge member secured to the first plate member and the second plate member to pivot the second plate member relative to the first plate member; a lip member secured to the second plate member to adjustably secure the second plate member to the housing; and a screw member to attach the lip member to the housing.

7. The flue gas recovery and/or recirculation and/or induced draft apparatus of claim 1 wherein said diverter member comprises a first semi-arcuate plate member secured to said housing; a second plate member pivotally secured to the first plate member; a hinge member secured to the first plate member and the second plate member to pivot the second plate member relative to the first plate member; a lip member secured to the second plate member to adjustably secure the second plate member to the housing; and a screw member to attach the lip member to the housing.

8. The flue gas recovery and/or recirculation and/or induced draft apparatus of claim 1 additionally comprising a condensate drain aperture disposed in a bottom of said housing, and a generally L-shaped condensate trap member positioned above said condensate drain and secured to the bottom and a pair of sides of said housing to capture any condensate contained in the combustion gas passing thereby.

9. The flue gas recovery and/or recirculation and/or induced draft apparatus of claim 7 additionally comprising a condensate drain aperture disposed in a bottom of said housing, and a generally L-shaped condensate trap member positioned above said condensate drain and secured to the bottom and a pair of sides of said housing to capture any condensate contained in the combustion gas passing thereby.

10. The flue gas recovery and/or recirculation and/or induced draft apparatus of claim 1 wherein said recirculated gas damper is positioned in a recirculated gas flue and coupled to said recirculated gas damper actuator; and wherein said recirculated gas damper is secured to the exterior of said housing.

11. The flue gas recovery and/or recirculation and/or induced draft apparatus of claim 9 wherein said recirculated gas damper is positioned in a recirculated gas flue and coupled to said recirculated gas damper actuator; and wherein said recirculated gas damper is secured to the exterior of said housing.

12. The flue gas recovery and/or recirculation and/or induced draft apparatus of claim 1 additionally comprising a generally cylindrical combustion gas flue positioned beside said fan and above said diverter such that said diverter is positioned therein and extends partly down the generally cylindrical combustion gas flue and into the path of the combustion gas flow.

13. The flue gas recovery and/or recirculation and/or induced draft apparatus of claim 11 additionally comprising a generally cylindrical combustion gas flue positioned beside said fan and above said diverter such that said diverter is positioned therein and extends partly down the generally cylindrical combustion gas flue and into the path of the combustion gas flow.

14. The flue gas recovery and/or recirculation and/or induced draft apparatus of claim 1 wherein said flue gas damper is positioned in a flue and coupled to said flue gas actuator; and wherein said flue gas damper is secured to the exterior of said housing.

15. The flue gas recovery and/or recirculation and/or induced draft apparatus of claim 13 wherein said flue gas damper is positioned in a flue and coupled to said flue gas actuator; and wherein said flue gas damper is secured to the exterior of said housing.

16. A heat recovery apparatus and flue gas recovery and/or recirculation and/or induced draft apparatus for boilers, or the like, comprising a heat recovery member and a flue gas recovery member secured to said heat recovery member and communicating therewith; said heat recovery member comprising a heat recovery housing having a first side member and a second side member, a pair of end members connected to said first side member and said second side member, a top and a bottom connected to said first side member and said second side member; said first side member having an aperture; a combustion gas inlet cone secured around said aperture of said first side member; a flue gas recovery housing comprising a fan shrouding means to convey a combustion gas secured to said first side member; a fan means disposed within said fan shrouding means and inside said combustion gas inlet cone to circulate a combustion gas; a motor coupled to said fan means to turn said fan means such that it may convey a combustion gas exiting said heat recovery member; a diverter means secured to one of the said end members to adjustably divert a determined quantity of said combustion gas to a flue gas recirculation duct; a flue gas recirculation duct means to convey a portion of a flue gas to a burner; a flue gas outlet duct member interconnected between said pair of end members and above said fan means and said diverter means; a flue gas damper member interposed in said flue gas outlet duct member having a flue gas damper shaft member attached thereto with said flue gas damper shaft member coupled to a flue gas damper lever member for pivotally operating the flue gas damper member to regulate the flue gas flow rate; and a flue gas damper actuator attached to the first side member and pivotally coupled to a flue gas damper lever member.

17. The heat recovery apparatus and flue gas recovery and/or recirculation and/or induced draft apparatus of claim 16 additionally comprising a recirculation duct damper interposed in said flue gas recirculation duct means; said recirculation duct damper comprising a recirculation damper shaft member attached to a recirculation damper actuator and to the recirculation duct damper.

18. The heat recovery apparatus and flue gas recovery and/or recirculation and/or induced draft apparatus of claim 17 wherein said diverter means comprises a structure defining a first plate member secured within said flue gas outlet duct member, and a second plate member hingeably secured to said first plate member to adjustably divert combustion gas flow.

19. The diverter member of claim 18 wherein said first plate member is semi-arcuate in shape.

20. The diverter member of claim 18 wherein said second plate member is semi-arcuate in shape.

21. The heat recovery apparatus and flue gas recovery and/or recirculation and/or induced draft apparatus of claim 18 additionally comprising at least one lip member secured to said second plate member to removeably secure said second plate member in position.

22. The heat recovery apparatus and flue gas recovery and/or recirculation and/or induced draft apparatus of claim 17 additionally comprising a condensate drain disposed in said flue gas recirculation duct means.

23. The heat recovery apparatus and flue gas recovery and/or recirculation and/or induced draft apparatus of claim 22 additionally comprising a condensate trap secured to said flue gas recirculation duct means and positioned above said condensate drain.

24. The condensate trap of claim 23 wherein said condensate trap comprises a generally vertical partition member secured to a bottom and a pair of sides, and a generally horizontal plate member secured to said partition member and to said pair of sides.

25. A process for recovering heat from hot combustion gases flowing through a combustion gas inlet in a bottom of a heat recovery housing additionally having a first pair of side walls including a flue gas exit in one of the side walls, a pair of end walls, a top, and a plurality of interconnected water conduit tubes provided with a roof and a cold water inlet in communication with one of said end walls to receive cold water and a hot water exit in communication with one of said end walls to dispense warm or hot water and circuitously passing through said heat recovery housing, and additionally recirculating back to a burner a portion of warm or hot combustion gases flowing from the flue gas exit of the heat recovery housing through a flue gas recovery and recirculation and induced draft housing comprising a second bottom, an arcuate end member, a generally upright cylindrical gas flue, a generally horizontal cylindrical recirculated gas flue, a fan, and a diverter member, said process comprising the steps of:

(a) providing a heat recovery housing;
(b) installing a first condensate drain in one of said first pair of side walls of said heat recovery housing;
(c) securing an inlet cone member around the flue gas exit of the heat recovery housing;
(d) providing a flue gas recovery and recirculation and induced draft apparatus;
(e) disposing a second condensate drain in said second bottom;
(f) securing a generally L-shaped condensate trap member above the condensate drain of step (e) to the second bottom;
(g) securing a lip member to said diverter member for locking the diverter member into a secure position;

(h) adjusting the diverter for regulating the amount of combustion gas that is to be recirculated;

(i) rotating said fan for drawing the combustion gases through the flue gas recovery and recirculation and induced draft housing;

(j) passing a first portion of combustion gas above the diverter member and through the generally upright cylindrical gas flue;

(k) passing a second portion of combustion gas below the diverter member;

(l) passing the second portion of combustion gas of step (k) through the generally horizontal recirculated gas flue;

(m) passing the combustion gas of step (l) through a recirculating duct to burner.

26. The process of claim 25 additionally comprising passing the combustion gas over the condensate trap prior to said passing step (l).

27. The process of claim 25 additionally comprising locking the diverter member with a bolt member prior to said rotating step (i).

28. The process of claim 25 additionally comprising disposing a first dampening means for regulating exit gas flow in said generally upright cylindrical gas flue.

29. The process of claim 25 additionally comprising disposing a second dampening means for regulating recirculation gas flow in said generally horizontal cylindrical recirculated gas flue.

30. The process of claim 28 additionally comprising adjusting said first dampening means for regulating exit gas flow.

31. The process of claim 29 additionally comprising adjusting said second dampening means for regulating recirculation gas flow.

32. The process of claim 25 additionally comprising circulating the combustion gas around the arcuate end member and centrifugally forcing any condensate formed by cooling gas to the outside of the gas flow.

33. The process of claim 32 additionally comprising trapping said condensate with said condensate trap, and draining said condensate from said second condensate drain.

* * * * *